United States Patent [19]

Heyden

[11] Patent Number: 4,595,307

[45] Date of Patent: Jun. 17, 1986

[54] RETRACTABLE IMPLEMENT CLOSURE

[76] Inventor: Eugene L. Heyden, S. 627 Bernard No. 8, Spokane, Wash. 99204

[21] Appl. No.: 667,092

[22] Filed: Nov. 1, 1984

[51] Int. Cl.[4] ..... B43K 9/00; B43K 23/00

[52] U.S. Cl. ..... 401/117; 401/88; 401/91

[58] Field of Search ..... 401/117, 99, 102, 214, 401/88, 6, 91

[56] References Cited

U.S. PATENT DOCUMENTS

| | | | |
|---|---|---|---|
| 1,291,972 | 1/1919 | McGuigan | 401/88 |
| 1,550,599 | 8/1925 | Walker . | |
| 1,598,873 | 9/1926 | Peterson | 401/6 |
| 1,714,965 | 5/1929 | Ullner . | |
| 1,839,817 | 1/1932 | Walker . | |
| 2,388,252 | 11/1945 | Crane | 401/6 X |
| 2,479,414 | 8/1949 | Sanbonmatsu . | |
| 2,559,555 | 7/1951 | Zepelovitch . | |
| 2,941,511 | 6/1960 | Cieremans . | |
| 3,061,084 | 10/1962 | Tibbitts | 401/102 X |
| 3,311,089 | 3/1967 | Vogel . | |
| 3,480,370 | 11/1969 | Koeln | 401/107 |
| 3,740,159 | 6/1973 | Smagala-Romanoff | 401/117 |
| 3,759,622 | 9/1973 | Miyamoto | 401/104 |
| 4,459,059 | 7/1984 | Greenspan | 401/117 |

FOREIGN PATENT DOCUMENTS

| | | | |
|---|---|---|---|
| 510400 | 10/1952 | Belgium | 401/88 |
| 2656346 | 8/1977 | Fed. Rep. of Germany | 401/99 |
| 1129142 | 1/1957 | France | 401/117 |
| 1252736 | 12/1960 | France | 401/214 |

*Primary Examiner*—Steven A. Bratlie

[57] ABSTRACT

A protective closure for an implement such as a pencil or pen. The closure comprises a retractable sheath intended for an attached relation to the implement body portion. The sheath having fold means is shortened or contracted longitudinally to achieve an exposing position when opposing sections of the sheath are urged together, achieving an intermediate, cross-sectionally continuous fold thereby. The fold means is further adapted to self-retain.

22 Claims, 5 Drawing Figures

RETRACTABLE IMPLEMENT CLOSURE

BACKGROUND OF THE INVENTION

This invention relates generally to implement closures and, more particularly to protective closures for writing implements such as pens or pencils, being strikingly suitable for use therewith.

It is common practice, especially in pen design and construction, to provide a protective means to safeguard the writing tip when not in use and to prevent unwanted marking of unintended objects such as shirt pockets. A removable cap is commonplace, as are the somewhat more costly and complex writing implements having one of a variety of transmission mechanisms for moving the writing tip in and out of register with a protective barrel member.

Inherent drawbacks to the above methods include loss or displacement of the cap and mechanical failure, as well as higher manufacturing complexity and cost, of the transmission mechanism employed. Accordingly, it has been the purpose of several existing closure devices, and writing implements incorporating the same, to provide an alternative to both the removable cap and commonly employed transmission mechanisms as means for protecting and exposing the writing tip of a pen or pencil. Representative of such devices are Zepelovitch, U.S. Pat. No. 2,559,555 and Vogel, U.S. Pat. No. 3,311,089.

A typical alternative, as demonstrated in the Zepelovitch patent, is the axially displacable closure mounted upon the writing implement end in the vicinity of the writing tip. Meant to be carried and retained thereupon, the closure slides in its entirety from an advanced, covering position to a retracted, exposing position with respect to the writing end and tip. Additional members as keepers, controlling the extent of movement and preventing unwanted retraction or removal of the closure.

Another alternative, as demonstrated in the Vogel patent, is a contracting casing for housing a conventional writing element or cartridge therein. In this patent, a forward casing portion is adapted for axial movement toward a rearward casing portion, thereby outwardly projecting or otherwise deforming a flexible intermediate casing portion intended for this means. Being axially stationary therein, the writing means of the cartridge is projected beyond the implement through a forward opening. Additionally, according to Vogel, the achieved writing position is maintained by finger pressure transmitted through the forward casing portion to the writing cartridge, or is self-retained therein by frictional engagement between the forward opening and the cartridge member.

SUMMARY OF THE INVENTION

In the preferred embodiment, the present invention provides an implement closure, specifically a writing implement closure, that provides isolation and protection of the writing tip. A simply constructed tubular sheath is provided which is adapted for an adherent relation to the body portion of an ordinary writing implement. While being stationarily carried upon the body portion of the implement in the vicinity of its writing end, the closure provides both a normally closed or enclosing position and an achieved open or exposing position with respect to the writing tip. The closure is adapted to flexibly fold upon itself to achieve a cross-sectionally continuous and self-retaining fold, not only contracting the length of the closure thereby, but also retaining the closure in its open or exposing position.

BRIEF DESCRIPTION OF THE DRAWING

The invention can best be understood in conjunction with the accompanying drawings to which the description of preferred embodiments correspond.

DETAILED DESCRIPTION OF THE INVENTION

Figure 1:
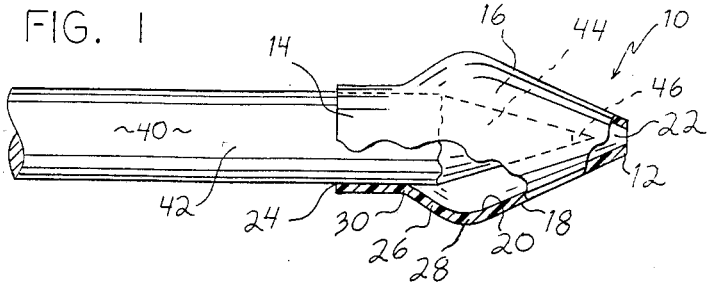
FIG. 1 shows the retractable closure according to the preferred embodiments of the invention, the closure presented in partial section and in a relaxed and covered relation to the forward end of a writing implement.
Figure 2:
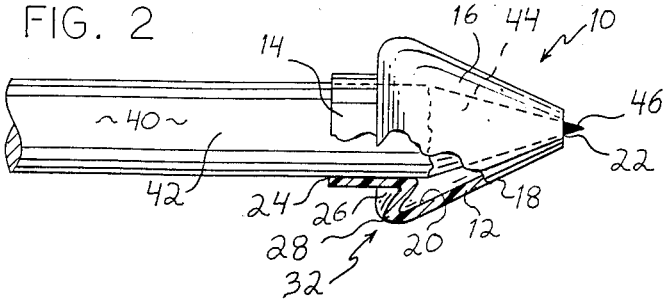
FIG. 2 shows the closure according to FIG. 1, also in partial section, in a retracted, exposing position.

Referring particularly to FIGS. 1 and 2, the closure comprises a sheath 10 of simple construction. One-piece in form, the sheath 10 is of tubular character having both a longitudinal extent and a cross-sectionally continuous wall 12 providing an inner wall surface 20 and an outer wall surface 18. The sheath 10 contains, as it were, a centrally open region and a central axis therein. The longitudinal extent of the sheath defines, by features of construction and intent of purpose, a forward sheath section 16 and a rearward sheath section 14, as will be discussed later in greater detail. The material used in its construction is both resilient and flexible in nature, being capable of sustaining a given shape and again recovering its shape having been folded or otherwise deformed.

The sheath 10 is shown in an adherent relation to the body portion 42 of a writing implement 40. FIG. 1 shows the sheath in its relaxed, enclosing state with respect to the writing end 44 and tip 46. In contrast, FIG. 2 shows the sheath 10 in its contracted, exposing state, particularly in regard to the writing end 44 and tip 46. The writing implement is itself of known construction as a common lead pencil. A pencil is used by way of example only, as a pen or other similarly constructed implement could be used representatively and in keeping with the scope of the invention.

Continuing in more detail, the sheath 10 further comprises both a foreward opening 22 and an opposing rearward opening 24 by which the centrally open region within the sheath wall 12 communicates with the region outside the sheath wall. Through the rearward opening 14 of the sheath, to within the central opening therein, is placed the forward end 44 and writing tip 46 of the implement. The writing tip 46 does not normally extend through or beyond the forward opening but does so when the sheath is in its contracted state. Forming an adherent relation to the implement body portion 42, the rearward section 14 of the sheath is carried thereupon in the vicinity of its forward end 44. This adherent relation is to be understood as stationary during both the enclosing and exposing positions of the sheath. However, the sheath may be removed as needed as when sharpening the implement, replacing a tip, or for attachment with another implement. The adherent relation itself comprises a substantially snug fit between the inner wall surface 20 of the rearward section 14 and the body portion 42 of the implement 40, as the sheath thereat conforms about the perimeter of the implement. The flexibly resilient nature of the sheath may act to accomplish this snug fitting by expanding somewhat to accommodate the perimetal extent of the implement body portion.

Comparative scrutiny of both FIGS. 1 and 2 reveals the means by which the sheath achieves a contracted state in its conversion from a relaxed, enclosing position to an achieved, exposing position. Again, when employed to use, the sheath 10 forms an adherent, stationary relation to the body portion 42 of the implement 40. In contrast, the remainder of the sheath, the forward section 16, is sufficiently enlarged to avoid restriction of movement between it and the forward end 44 and tip 46 of the implement. This is particularly achieved by the cross-sectional and longitudinal configuration of the sheath in its forward section 16, the major part being of conical configuration. As shown, the forward section 16 is conically largest in the vicinity of, and with respect to, the rearward section 14 and smallest in the vicinity of the forward opening 22. Conforming about the end and tip of the implement thereat in spaced-apart relation, the forward section 16, so configured, further defines an inclining portion 26 leading from the comparatively smaller rearward section 14 to the comparatively larger portion of the forward section. Recalling the cross-sectionally continuous extent of the sheath wall 12, it can be readily appreciated that the respective angular intersections 28 and 30 afforded by the inclining portion 26 of the sheath 10 effectively biases the sheath to alter in degree of angulation when the forward 16 and rearward 14 sections are urged together. A cross-sectionally continuous fold 32 is therefore established as the inclining forward portion 26 folds backward, thereby substantially approximating its inner wall surface with that of a portion of the forward sheath 16 and, substantially approximating its outer wall surface with that of a portion of the rearward sheath section 14. It is also of note that the extent of sheath contraction is a function of the longitudinal extent of the inclining sheath portion.

Preceding further, the means by which the sheath is adapted to maintain and reverse its folded, contracted state is as follows: The forward sheath section 16 is enlarged rearwardly and only to an extent as to closely conform about both the inclining sheath portion 26 and the forward portion of the rearward sheath section 14 when the fold 32 is achieved. In this way, the now reversed inclining portion 26 is restrictively held between portions of the forward and rearward sections of the sheath, resisting the resiliency tending to return the sheath to its usual extended form. Reversing the achieved fold 32 is a matter of urging the opposing rearward 14 and forward 16 sections apart, returning the sheath 10 again to its relaxed, uncontracted state.

Figure 3:
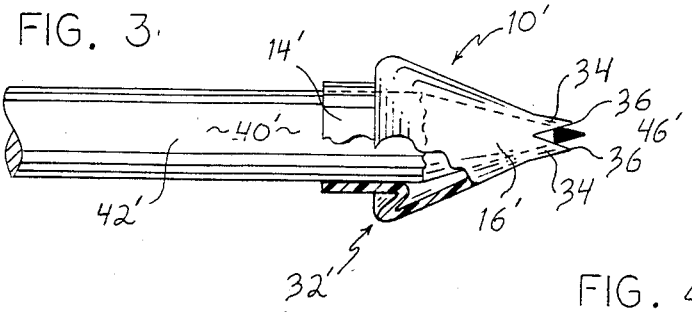
FIG. 3 shows an alternative embodiment of the closure, particularly pointing out an alternative construction within the scope of the invention.

FIG. 3 is useful to illustrate an alternative embodiment of the invention, particularly pointing out an alternative to the forward opening of FIGS. 1 and 2. Having a forward section 16', an opposing rearward section 14', and a fold means 32' structurally and operationally as described above, the sheath 10' in its forward section 16', specifically the forward communication means, is invariently constructed. Instead of a continuously open forward opening (22), the communication means comprises a pair of approximating leaves 34 as the conical forward section 16' is formed to proceed to an end point 36. Formed by a cross-wise slit in the forward end of the sheath, the leavels 34 spread apart to accommodate therethrough the writing tip 46' of the implement. In a closed, approximating attitude, the leaves 34 would act occlusively to protect the writing tip 46, if indicated by the nature of the implement, from evaporation or particle contamination.

Figure 4:
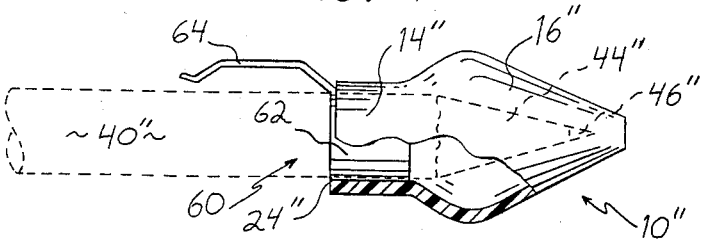
FIG. 4 shows the closure in attached relation to a writing implement retaining clip, pointing to an alternative means of achieving an adherent relation to a writing implement.

FIG. 4 illustrates a sheath closure identical to FIGS. 1 and 2, teaching an alternative to direct attachment between the sheath and the implement body. A retaining clip structure 50 of common feature, having a centrally open ring member 62 with a rearward extending clip finger 64, is fitted within the rearward section 14'' of the sheath 10''. This ring member 62 supports the sheath 10'', and in turn receives the forward end 44'' and tip 46'' of the implement within. The ring member 62 thereupon conforms about the implement 40'' to effect an adherent attachment between the sheath 10'' and the implement 40''.

Figure 5:
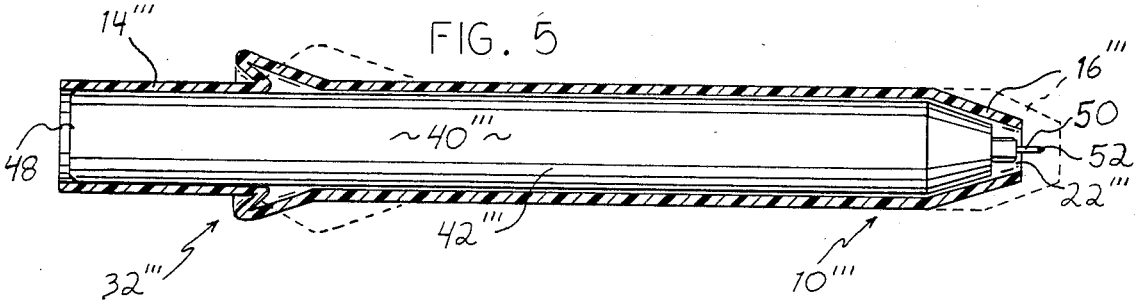
FIG. 5 shows an additional embodiment within the scope of the invention, depicting yet another alternative embodiment of the closure.

FIG. 5 depicts an alternative embodiment of the closure wherein the sheath 10''' forms a more extensive relation to the writing implement, confining within its wall the implement in its entirety. The implement 40''' in this figure is a common ball-point pen, having an elongated body portion 42''', and forward end 44''' leading to and supporting an ink cartridge 50 and ball-point writing tip 52. The sheath itself, like in the preceding forms, is constructed similarly and operates substantially in the same manner. The forward section 16''' and forward opening 22''' are, accordingly, in spaced-apart and slidable relation to the associating portion of the implement 40'''. The rearward section 14''', accordingly, forms a stationary, adherent relation to rearward end 48 of the implement 40''' and is also shown as covering this end of the implement in its entirety. The fold means 32''' is strategically placed near to the rearward end 48, away from the implement portion normally held during use.

It should be noted, in addition to the above description of the invention in its several portrayed embodiments, that other means may be incorporated in the closure design to influence its function. Particularly speaking, the self-retaining feature of the fold means may be advantageously augmented by a constricting fit between the writing end or tip of the implement and the forward sheath section or opening, or by finger pressure transmitted through the forward sheath section to the implement body portion. Also to be noted, one or a combination of these methods may be used as the sole means of retaining the sheath in its folded state, exclusive of the particular self-retaining feature of the preferred embodiments.

It is to be recognized that though the sheath, as portrayed, is configured to achieve a generally external fold, it would be in keeping with the present invention to so configure the sheath as to fold inwardly to achieve a contracted, exposing position.

As can be readily understood from the foregoing, the practice of the invention may be according to various embodiments.

Although described in relation to writing implements such as pencils and pens, various other devices such as cosmetic applicators, or other similarly constructed implements needing end-point protection, could be improved and benefited by the present invention. In addition, the closure itself, as well as an implement unitarily incorporating the same, is within the spirit and scope of the invention.

In keeping with both the foregoing description of the invention in its several portrayed embodiments and the intent thereof, what is claimed as exclusive property or priviledge is:

1. A retractable closure for an implement having an elongated body portion and at least one end having work performance means, said closure comprising:

an elongated tubular sheath of foldably resilient material defining a wall with an inner wall surface and an outer wall surface, said sheath also having a central axis and a centrally open region therein;

a forward sheath section including forward communication means adapted for axial displacement from a normally enclosing position to an achieved exposing position with respect to said work performance means;

a rearward sheath section including rearward communication means adapted to receive said end and said work performance means therethrough, said rearward sheath section also adapted to form an adherent relation to, and a degree of resistance to displacement from, at least a portion of said implement;

fold means integral with said sheath in the vicinity of said rearward sheath section for adjusting the length of said sheath, said sheath thereby and thereat biased to fold upon itself into a fold bringing a portion of said forward sheath section and a portion of said rearward sheath section in overlapping position, said sheath contracting in length from an enclosing first position to an exposing second position with respect to said work performance means when attached to said implement, said work performance means extending through said forward communication means when so exposed; and, fold retaining means for retaining said sheath in said exposing second position, said fold retaining means retaining the folded state of said sheath when actuated to achieve said fold.

2. The closure of claim 1, wherein said forward sheath section is conical in its forward part, said forward sheath section of conical configuration being largest in the direction of said rearward sheath section and smallest in the direction of said forward communication means.

3. The closure of claim 1, wherein said forward communication means comprises said forward sheath section providing an opening therein, said opening continuously open and located forwardmost in said forward sheath section.

4. The closure of claim 2, wherein said forward communication means comprises a plurality of approximating leaves, said leaves formed by separations forwardmost in said forward sheath section and separable to accommodate the work performance means of said implement therethrough.

5. The closure of claim 1, wherein said rearward sheath section extends in length a substantial distance from said fold means.

6. The closure of claim 1, wherein said adherent relation comprises a substantially snug fitting between said rearward sheath section and the body portion of said implement.

7. The closure of claim 6, wherein the rearward portion of said sheath is somewhat expansible, said adherent relation comprising a substantially snug fitting as accomplished by said rearward sheath section adapted to expand in allowance around the perimeter of the body portion of said implement.

8. The closure of claim 1, wherein said adherent relation comprises a first adherent relation to a supporting member, said supporting member for forming a second adherent relation to the body portion of said implement.

9. The closure of claim 8, wherein said supporting member is a retaining clip means.

10. The closure of claim 1, wherein the wall portion of said sheath is cross-sectionally continuous in the area providing said fold means, and said forward sheath section is cross-sectionally enlarged in a portion in the vicinity of said fold means with respect to said rearward sheath section, said fold means comprising a forwardly inclining wall portion of said sheath that inclines forwardly from said rearward sheath section to the enlarged portion of said sheath provided in said forward sheath section, said forwardly inclining wall portion folding backward in direction as said fold is achieved.

11. The closure of claim 10, wherein said forwardly inclining wall portion folds backward in direction to a cross-sectionally continuous fold when said forward sheath section and said rearward sheath section are urged together, said forwardly inclining wall portion substantially approximately its inner wall surface with that of a portion of said forward sheath section and, substantially approximating its outer wall surface with that of a portion of said rearward sheath section as said fold is achieved.

12. The closure of claim 1, wherein said fold retaining means comprises a wall portion of said sheath restrictively held between overlapping portions of said sheath.

13. The closure of claim 12, wherein said fold means is reversed from a retained state by directionally urging said forward sheath section and said rearward sheath section apart.

14. The closure of claim 1, wherein said implement is held by an operator, and said fold means is disposed along said sheath rearwardly a distance from an area normally held during use of said implement.

15. An implement comprising:

an elongated body portion;

a forward end having work performance means;

a rearward end, said rearward end opposing said forward end;

an elongated tubular sheath of foldably resilient material carried upon said implement in the vicinity of said forward end;

said sheath including a forward sheath section and forward communication means in an extending first position and in spaced-apart and movable relation to said forward end and said work performance means;

said sheath also having a rearward sheath section in a substantially adherent relation to at least a part of said implement;

fold means integral with said sheath in the vicinity of said rearward sheath section for adjusting the length of said sheath, said sheath thereby and thereat biased to fold upon itself into a fold bringing a portion of said forward sheath section and a portion of said rearward sheath section in overlapping relation, said sheath contracting in length from an enclosing first position to an exposing said position with respect to said work performance means, said work performance means extending through said forward communication means when so exposed; and, fold retaining means for retaining said sheath in said exposing second position, said fold retaining means retaining the folded state of said sheath when actuated to achieve said fold.

16. The implement of claim 15, wherein said forward sheath section is conical in configuration in its forward part, said forward sheath section of conical configuration being largest in the direction of said rearward sheath section and smallest in the direction of said forward communication means.

17. The implement of claim 15, wherein said forward communication means comprises said forward sheath section providing an opening therein, said opening continuously open and located forwardmost in said forward sheath section.

18. The implement of claim 16 wherein said forward communication means comprises a plurality of approximating leaves, said leaves formed by separations forwardmost in said forward sheath section and spreadable to accommodate said work performance means therethrough.

19. The implement of claim 15, wherein the wall portion of said sheath is cross-sectionally continuous in the area providing said fold means, and said forward sheath section is cross-sectionally enlarged in a portion of the vicinity of said fold means with respect to said rearward sheath section, said fold means comprising a forwardly inclining wall portion of said sheath that inclines forwardly from said rearward sheath section to the enlarged portion of said sheath provided in said forward sheath section, said forwardly inclining wall portion folding backward in direction as said fold is achieved.

20. The implement of claim 15, wherein said fold retaining means comprises a wall portion of said sheath respectively held between overlapping portions of said sheath.

21. The implement of claim 15, wherein said fold means is reversed from a retained state by directionally urging said forward sheath section and said rearward sheath section apart.

22. The implement of claim 15, wherein said implement is manually held during use, and said fold means is disposed along said sheath rearwardly a distance from an area normally held during use of said implement.

* * * * *

UNITED STATES PATENT AND TRADEMARK OFFICE

CERTIFICATE OF CORRECTION

PATENT NO. : 4,595,307

DATED : June 17, 1986

INVENTOR(S) : Eugene L. Heyden

It is certified that error appears in the above-identified patent and that said Letters Patent are hereby corrected as shown below:

Col. 1, line 36, after "members" insert --are provided to coact with corresponding implement members--.

Col. 2, line 63, after "opening" insert --22 when the sheath is in its relaxed, enclosing position--.

Col. 3, line 41, after "inclining" delete "forward";
line 43, after "sheath" insert --section--;
line 48, delete "sheath";
ling 49, "preceding" should be --proceeding--;
line 53, after "inclining" delete "sheath".

Col. 4, line 10, "46" should be --46'--;
line 38, after "to" insert --the--.

Col. 5, line 35, "position" should be --relation--.

Col. 7, line 2, "said" should be --second--;
line 24, place a comma after "16".

Signed and Sealed this

Twenty-eighth Day of October, 1986

[SEAL]

*Attest:*

DONALD J. QUIGG

*Attesting Officer*

*Commissioner of Patents and Trademarks*